US005356547A

United States Patent [19]

Arai et al.

[11] Patent Number: 5,356,547

[45] Date of Patent: Oct. 18, 1994

[54] LUBRICATING OIL COMPOSITION CONTAINING FRICTION MODIFIER AND CORROSION INHIBITOR

[75] Inventors: Katsuya Arai; Toshikazu Tsukada, both of Ohi; Hirotaka Tomizawa, Tokorozawa, all of Japan

[73] Assignee: Exxon Research & Engineering Co., Florham Park, N.J.

[21] Appl. No.: 89,876

[22] Filed: Jul. 9, 1993

[30] Foreign Application Priority Data

Jan. 9, 1992 [JP] Japan ..... 4-20408

[51] Int. Cl.[5] ..... C10M 135/14

[52] U.S. Cl. ..... 252/46.4

[58] Field of Search ..... 252/46.4

[56] References Cited

U.S. PATENT DOCUMENTS

| | | | |
|---|---|---|---|
| 3,251,661 | 5/1966 | Retzloff et al. | 252/46.4 |
| 4,529,526 | 7/1985 | Inoue et al. | 252/32.7 |
| 4,925,596 | 5/1990 | Maeda et al. | 252/32.7 E |

*Primary Examiner*—John Niebling
*Assistant Examiner*—Edna Wong
*Attorney, Agent, or Firm*—James H. Takemoto

[57] ABSTRACT

An improved lubricating oil composition having a low coefficient of friction and reduced copper corrosion comprising (a) lubricating oil basestock, (b) 0.01 to less than 0.2% by weight, based on the oil composition, of at least one organomolybdenum compound selected from the group consisting of sulfurized oxymolybdenum dithiocarbamate and sulfurized oxymolybdenum organophosphorodithioate; and (c) from 0.5 to 7% by weight, based on the oil composition, of at least one organozinc compound selected from the group consisting of zinc dithiophosphate and zinc dithiocarbamate.

5 Claims, No Drawings

LUBRICATING OIL COMPOSITION CONTAINING FRICTION MODIFIER AND CORROSION INHIBITOR

BACKGROUND OF THE INVENTION

Field of the Invention

The present invention relates to a lubricating oil composition having a low coefficient of friction and a reduced copper corrosiveness.

Description of the Related Art

In recent years, an increase in the output of internal combustion engines such as automobile engines has caused individual parts of the engine, for example, valve operating systems and cylinders, to be exposed to high temperatures. Moreover, the number of contacts per unit time of metals with each other has been increased, thus placing the internal combustion engine under severe operating conditions. Lubricating oils for internal combustion engines must function under severe operating conditions. With a reduction in engine size and an increase in the engine performance which results in an increase in the number of revolutions and an increase in the output, engine oils are required to be versatile and possess high levels of performance.

Examples of fundamental performances required of the engine oils include detergency, dispersancy, a reduction in friction, reduction of wear and seizing, reduction of thermal and oxidative deterioration, reduction of corrosion, and cooling and sealing functions. Japanese Patent Publication No. 23595/1991 proposes a lubricating oil composition particularly useful in the reduction in the mechanical friction loss of four-cycle engines, said lubricating oil composition comprising a mineral oil and/or a synthetic oil having a kinematic viscosity at 100° C. of 3 to 20 cSt and, incorporated therein, (a) 0.2 to 5% by weight of sulfurized oxymolybdenum organophosphorodithioate (herein abbreviated to "MoDTP") and/or molybdenum dithiocarbamate (hereinafter abbreviated to as "MoDTC"), (b) 0.1 to 7% by weight of zinc dithiophosphate, (c) 0.1 to 20% by weight of calcium alkylbenzenesulfonate and (d) 1 to 15% by weight of an alkenylsuccinimide and/or a borated alkenylsuccinimide. According to this lubricating oil composition, the coefficient of friction in the mixed/boundary region can be reduced to about $\frac{1}{3}$ of that for the conventional engine oil.

One of the important features of the lubricating oil is that the lubricating oil does not attack a metal present within the engine during use. Free sulfur, sulfur compounds or acidic substances are considered to cause corrosion. Since the copper plate is most sensitive to these substances, the corrosion of a copper plate when exposed to lubricating oil is evaluated as a measure of the corrosiveness of the lubricating oil. It is a common practice to add nitrogenous metal deactivators, such as benzotriazole, to the lubricating oil for the purpose of reducing the copper corrosivness. However, the addition of these metal deactivators in a large amount results in hardening of sealing rubbers.

On the other hand, when MoDTP or MoDTC is added in relatively large amounts of 0.2 to 5% by weight as disclosed in the above cited Japanese Patent Publication for the purpose of reducing friction, the copper corrosion activity is unacceptably increased.

Further, lubricating oils containing organomolybdenum compounds, such as MoDTP or MoDTC, have a problem of high coefficient of friction at an early stage, i.e., at the stage of running-in. The additive to the lubricating oil is absorbed on the surface of the metal to form a boundary lubrication film which serves to reduce a boundary friction. A relatively substantial amount of time is taken for the organomolybdenum compounds to be absorbed on the surface of the metal to develop the effect of reducing the friction. When lubricating oil compositions containing the organomolybdenum compounds are used as an engine oil, the effect of reducing the friction develops after running a distance of 2000 to 3000 km, although this depends upon the running conditions of automobiles. However, after the above-described running, the time for the development of the effect of reducing the friction often overlaps with the time for the replacement of the engine oil. In such a case, an increase in the amount of addition of MoDTP or MoDTC does not lead to the development of the effect of reducing the friction at an earlier stage and rather increases the copper corrosiveness.

It would be desirable to provide a lubricating oil composition having a low coefficient of friction and a reduced copper corrosiveness. It would also be desirable to provide a lubricating oil composition which exhibits a low coefficient of friction from an early stage and has reduced copper corrosiveness.

SUMMARY OF THE INVENTION

The present invention relates to improved lubricating oil compositions having a low coefficient of friction, reduced copper corrositivity and which exhibits a low coefficient of friction from an early operating stage. The lubricating oil composition comprises:

a) a lubricating oil basestock;

b) from 0.01 to less than 0.2% by weight, based on the composition, of at least one organomolybdenum compound selected from the group consisting of sulfurized oxymolybdenum dithiocarbamate and sulfurized oxymolybdenum organophosphorodithioate; and c) from 0.5 to 7% by weight, based on the composition, of at least one organozinc compound selected from the group consisting of zinc dithiophosphate and zinc dithiocarbamate.

In another embodiment, the lubricating oil composition further comprises from 0.01 to 5% by weight, based on the composition, of an organic acid amide in addition to components (b) and (c) above. The present invention is also directed to a method for reducing friction and copper corrosion in an internal combustion engine which comprises operating the engine with the lubricating oil composition containing components (a)–(c) above.

DETAILED DESCRIPTION OF THE INVENTION

The mineral oil and/or synthetic oil used as a base oil in the lubricating oil composition of the present invention has a kinematic viscosity at 100° C. of 3 to 20 cSt, preferably 4 to 15 cSt. Examples of the mineral oil include 60 neutral oil, 100 neutral oil, 150 neutral oil, 300 neutral oil, 500 neutral oil and a bright stock. Examples of the synthetic oils include polyolefin, polyglycol ester, polyol ester, phosphoric ester, silicone oil, alkyldiphenyl, alkylbenzene and dibasic acid ester. These base oils may be used alone or in the form of a mixutre of two or more of them.

MoDTC and MoDTP used in the present invention are organomolybdenum compounds respectively represented by the following general formulae I and II:

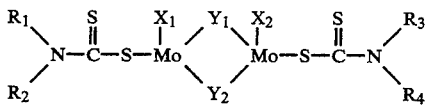

[I]

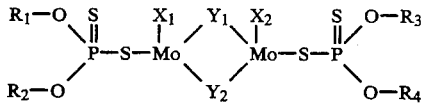

[II]

In the general formulae [I] and [II], $R_1$ to $R_4$ may be the same or different and each is independently a hydrogen atom; an alkyl group having 1 to 20 carbon atoms; a cycloalkyl group having 6 to 26 carbon atoms; an aryl, alkylaryl or arylalkyl group having 6 to 26 carbon atoms; or a hydrocarbon group having 3 to 20 carbon atoms and containing an ester bond, an ether bond, an alcohol group or a carboxyl group. $X_1$ and $X_2$ may be the same or different and each is independently an oxygen atom or a sulfur atom, $Y_1$ and $Y_2$ may be the same or different and each is independently an oxygen atom or a sulfur atom.

In the general formulae I and II, $R_1$ to $R_4$ are preferably a saturated or unsaturated alkyl or alkenyl group having 6 to 18 carbon atoms, cycloalkyl group having 12 to 24 carbon atoms or an alkylaryl group having 12 to 24 carbon atoms. Preferred examples thereof include alkyl and alkenyl groups having 6 to 18 carbon atoms, such as n-hexyl, 2-ethylhexyl, n-octyl, nonyl, decyl, lauryl, tridecyl, oleyl and linoleyl, and alkylaryl groups substituted with an alkyl group having 3 to 18 carbon atoms, such as nonylphenyl.

The amounts of MoDTC and MoDTP incorporated into the oil composition is from 0.01 to less than 0.2% by weight based on the oil composition independently of whether MoDTC and MoDTP are used alone or in combination thereof. When the amount is less than 0.01% by weight, the effect of reducing friction is very small. On the other hand, when the amount exceeds 0.2% by weight, the copper corrosiveness becomes significant. The amount of MoDTC and/or MoDTP is preferably in the range of from 0.03 to 0.18% by weight. MoDTC and MoDTP are commercially available from Asahi Denka Kogyo k.k., a Japanese Corporation and from R. T. Vanderbilt, Norwalk, Conn. The addition of MoDTC or MoDTP in the above-described low amounts was believed to be unsuitable for attaining a sufficient friction reduction effect. However, it has been surprisingly found that an excellent effect of reducing the coefficient of friction can be attained through the addition of MoDTC and/or MoDTP even in the above-described amounts when they are used in synergistic combination with ZnDTP and/or ZnDTC.

ZnDTP and ZnDTC used in the present invention are organozinc compounds respectively represented by the following general formulae III and IV:

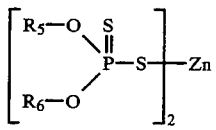

[III]

-continued

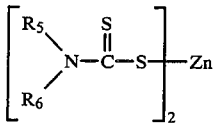

[IV]

In the general formulae III and IV, $R_5$ and $R_6$ may be the same or different and each is independently a hydrogen atom; an alkyl group having 1 to 20 carbon atoms; a cycloalkyl group having 6 to 26 carbon atoms; an aryl, alkylaryl or arylalkyl group having 6 to 26 carbon atoms; or hydrocarbon group having from 3 to 20 carbom atoms and containing an ester bond, and ether bond, an alcohol group or a carboxyl group.

In the general formulae III and IV $R_5$ and $R_6$ are preferably independently an alkyl group having 2 to 12 carbon atoms, a cycloalkyl group having 8 to 18 carbon atoms and an alkylaryl group having 8 to 18 carbon atoms.

ZnDTP and ZnDTC are commercially available from Amoco Chemical Company and Exxon Chemical Company and are incorporated either alone or in combination in an amount of 0.5 to 7% by weight based on the oil composition. These compounds serve as an extreme-pressure agent, an antioxidant, a corrosion inhibitor, etc. When the amount of these compounds incorporated into the oil composition is excessively low, no satisfactory effect of addition can be attained. On the other hand, when it is excessively high, the effect of addition is often saturated or even lowered.

The organic amide used in the present invention is a compound represented by the following general formula V:

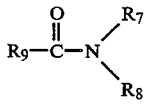

[V]

In the general formula V, $R_7$ and $R_8$ may be the same or different stand and each is independently a hydrogen atom; an alkyl group having 1 to 20 carbon atoms; a cycloalkyl group having 6 to 26 carbon atoms; an aryl, alkylaryl or arylalkyl group having 6 to 26 carbon atoms; or an alkylene oxide group having 2 to 30 carbon atoms, and $R_9$ stands for a hydrogen atom; an alkyl group having 1 to 20 carbon atoms; a cycloalkyl group having 6 to 26 carbon atoms; an aryl, alkylaryl or arylalkyl group having 6 to 26 carbon atoms; or a hydrocarbon group having from 3 to 20 carbon atoms and containing an ester bond, an ether bond, an alcohol group or a carboxyl group.

The term "alkylene oxide group, used herein is intended to mean groups represented by the following general formula VI and/or VII:

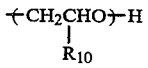

[VI]

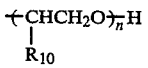

[VII]

In the general formulae VI and VII, n is an integer of 1 to 10, and $R_{10}$ stands for a hydrogen atom or a methyl group.

In the general formula V, the $R_7$ and $R_8$ are preferably independently a hydrogen atom, an alkyl group having 2 to 8 carbon atoms, cycloalkyl group having 8 to 14 carbon atoms, an alkylaryl group having 8 to 14 carbon atoms or an alkylene oxide group wherein n is 1 to 5. $R_9$ is preferably a saturated or unsaturated alkyl group having 6 to 18 carbon atoms, cycloalkyl group having 12 to 24 carbon atoms or an alkylaryl group having 12 to 24 carbon atoms. Examples of such an organic amide compound include oleamide and lauramide.

The amount of the organic amide compound is 0.01 to 5% by weight, preferably 0.05 to 2% by weight based on the oil composition. The addition of the organic amide compound enables the coefficient of friction to be lowered from an early stage while inhibiting copper corrosion. If the amount is excessively low, the effect of lowering the coefficient of friction in an early stage is small. On the other hand, if the amount is excessively high, the effect is saturated.

If desired, other additives, for example, other extreme-pressure agents, ashless detergent dispersants, antioxidants, metallic detergents, metal deactivators, viscosity index improvers, pour point depressants, rust preventives, antifoaming agents, and corrosion inhibitors, may be added to the lubricating oil composition.

Examples of the ashless detergent dispersant include those based on succinimide, succinamide, benzylamine and esters, and it is also possible to use boron-based ashless detergent dispersants. They are generally used in a proportion of 0.5 to 7% by weight.

Examples of the antioxidant include amine-based antioxidants, such as alkylated diphenylamine, phenyl-α-naphthylamine and alkylated α-naphthylamine, and phenolic antioxidants, such as 2,6-di-tert-butylphenol and 4,4'-methylenebis-(2,6-di-tert-butylphenol), and they are generally used in a proportion of 0.05 to 2.0% by weight.

Examples of the metallic detergents include Ca sulfonate, Mg sulfonate, Ba sulfonate, Ca phenate and Ba phenate, which are generally used in a proportion of 0.1 to 5% by weight.

Examples of the metal deactivator include benzotriazole, benzotrazole derivatives, benzothiazole, benzothiazole derivatives, triazole, triazole derivatives, dithiocarbamate, dithiocarbamate derivatives, indazole and indazole derivatives, which are generally used in a proportion of 0.005 to 0.3% by weight.

Examples of the viscosity index improver include polymethyl methacrylate, polyisobutylene, ethylene-propylene copolymer and styrene-butadiene hydrogenated copolymer, which are generally used in a proportion of 0.5 to 35% by weight.

Examples of the rust inhibitor include an alkenylsuccinic acid and a partial ester thereof, which are added as needed.

Examples of the antifoaming agent include dimethylpolysiloxane and polyacrylate, which are added as needed.

The lubricating oil composition of the present invention can be produced by incorporating the desired amount of the above-described various additives to a mineral oil and/or a synthetic oil as a base oil and homogeneously mixing them with each other. The lubricating oil composition of the present invention can be used in extensive fields as lubricating oils including engine oils and, further, gear oils, ATF, PS fluids, spindle oils, hydraulic oils, industrial lubricating oils, etc.

The present invention is further illustrated with reference to the following Examples which include a preferred embodiment of the invention.

The properties of the lubricating oils were measured by the following methods.

MEASUREMENT OF COEFFICIENTS OF FRICTION

The coefficient of friction of each lubricating oil was measured with a reciprocal vibration friction tester (SRV).

In the SRV tester, a steel ball having a diameter of ½ inch (SUJ-2 specified in JIS G4805) was used as the upper test piece, and a steel disk (SUJ-2 specified in JIS G 4805) was used as the lower test piece. A sample oil was dropped on the lower test piece, a load was applied to the upper test piece from the top, and the upper test piece was vibrated parallel to the lower test piece with the upper test piece being pressed against the lower test piece. The lateral load applied to the lower test piece was measured to calculate the coefficient of friction (u). The coefficient of friction was measured twice, that is, 5 minutes and 20 minutes after the initiation of the vibration of the upper test piece. Testing conditions were as follows:

load: 100 N,
temperature: 130° C.
frequency: 8 Hz, and
amplitude: 4 mm.

COPPER CORROSIVENESS

A corrosiveness test was conducted at a testing temperature of 100° C. and a testing time of 3 h by the test tube method according to JIS K 2513 "Petroleum Products-Corrosiveness to Copper-Copper Strip Test" and the state of discoloration of the copper plate was observed according to the Standards for Copper Plate Corrosion to evaluate the corrosiveness according to subdivisional symbols 1a to 4c. The smaller the numeral of the subdivisional symbol, the lower the corrosiveness, and the corrosiveness increases in alphabetical order.

Specific evaluation examples are as follows:

1a: a pale orange color which is substantially the same as the color of a finish-polished copper plate,
1b: a deep orange color,
3a: a reddish brown pattern on the brass color.

EXAMPLES 1 to 10 and COMPARATIVE EXAMPLES 1 and 2

4% by weight of Ca sulfonate, 5% by weight of succinimide, 0.5% by weight of an alkylated diphenylamine, 0.3% by weight of 2, 6-di-tert-butylphenol and 0.02% by weight of 4-methylbenzotriazole were incorporated into a mineral oil (150 neutral mineral oil; kinematic viscosity at 100° C. of 5.1 cSt), and the various components listed in Table 1 were added thereto to prepare lubricating oil compositions. The amount in % by weight of each component is based on the oil composition, and the balance is the amount in % by weight of the mineral oil. The results of measurement of the properties are given in Table 1.

Individual components are described as follows:

(1) MoDTC (SaKura-lube ® manufactured by Asahi Denka Kogyo k.k.)

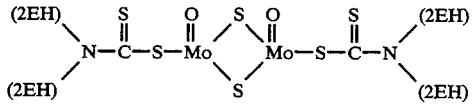

wherein 2EH stands for 2-ethylhexyl group, (2) MoDTP (Molyvan L® manufactured by R. T. Vanderbilt)

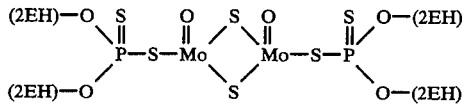

wherein 2EH stands for 2-ethylhexyl group, (3) ZnDTP (Paranox 16® manufactured by Exxon Chemical Co.)

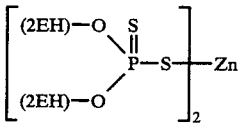

wherein 2EH stands for a 2-ethylhexyl group, (4) ZnDTC

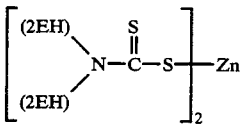

wherein 2EH stands for a 2-ethylhexyl group, (5) Ca sulfonate (Hitec G11® manufactured by Ethyl Corp.)

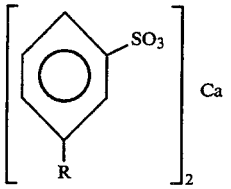

wherein R stands for an alkyl group having 10 carbon atoms, and (6) Succinimide

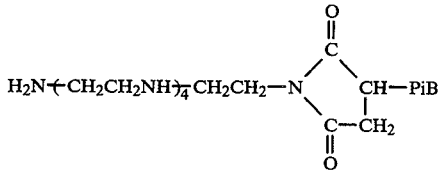

wherein PiB stands for polyisobutylene

TABLE 1

| | | EXAMPLES | | | | | | | | | | COMPARATIVE Ex | |
|---|---|---|---|---|---|---|---|---|---|---|---|---|---|
| | | 1 | 2 | 3 | 4 | 5 | 6 | 7 | 8 | 9 | 10 | 1 | 2 |
| MoDTC | | 0.15* | 0.07 | — | — | 0.05 | 0.10 | 0.15 | 0.07 | — | 0.10 | 0.30 | 0.15 |
| MoDTP | | — | — | 0.15 | 0.07 | 0.05 | 0.05 | — | — | 0.15 | 0.05 | — | 0.15 |
| ZnDTP | | 2.0 | 3.0 | 2.0 | 1.5 | 2.0 | 1.5 | 2.0 | 3.0 | 2.0 | 1.5 | 2.0 | — |
| ZnDTC | | — | — | 1.5 | 1.5 | — | 1.0 | — | — | 1.5 | 1.0 | — | |
| Oleic amide | | — | — | — | — | — | — | 0.1 | 1.2 | — | — | — | — |
| Lauramide | | — | — | — | — | — | — | — | — | 0.3 | 1.0 | — | — |
| Coefficient | After 5 Min | 0.12 | 0.13 | 0.12 | 0.12 | 0.12 | 0.12 | 0.12 | 0.05 | 0.06 | 0.05 | 0.13 | 0.12 |
| | After 20 Min | 0.04 | 0.05 | 0.05 | 0.05 | 0.05 | 0.04 | 0.05 | 0.05 | 0.05 | 0.05 | 0.11 | 0.80 |
| Copper Corrosion | | 1a | 1a | 1b | 1a | 1b | 1b | 1a | 1a | 1a | 1b | 3a | 1a |

*Percent by weight, based on the oil composition.

As is apparent from Table 1, each of the lubricating oil compositions of Examples 1 to 6 of the present invention had a small coefficient of friction 20 minutes after the initiation of the test and, and the same time, a small copper corrosiveness. By contrast, the lubricating oil composition of Comparative Example 1 wherein MoDTC was incorporated in an amount of 0.30% by weight had a large coefficient of friction 20 minutes after the initiation of the test and, at the same time, a large copper corrosiveness. Further, the lubricating oil compostion of Comparative Example 2 wherein neither ZnDTP nor ZnDTC was used in combination with MoDTC or MoDTP had a tendency that the coefficient of friction increases.

Further it is apparent that each of the lubricating oil compositions of Examples 7 to 10 wherein an organic amide compound was also used had a small coefficient of friction 5 minutes after the initiation of the test, which suggests that these lubricating oil compositions exhibit the effect of reducing the friction from the beginning.

We claim:

1. A lubricating oil composition which comprises:

a) a lubricating oil basestock;

b) from 0.01 to less than 0.2% by weight, based on the oil composition, of at least one organomolybdenum compound selected from the group consisting of sulfurized oxymolybdenum dithiocarbamate and sulfurized oxymolybdenum organophosphorodithioate;

c) from 0.5 to 7% by weight, based on the oil composition, of at least one organozinc compound selected from the group consisting of zinc dithiophosphate and zinc dithiocarbamate; and d) from 0.01 to 5% by weight, based on the oil composition, of an organic acid amide.

2. The composition of claim 1 wherein the sulfurized oxymolybdenum dithiocarbamate and the sulfurized oxymolybdenum organophosphorodithioate have the respective formulae

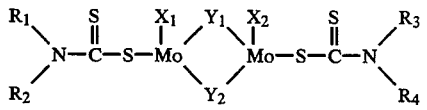

[I]

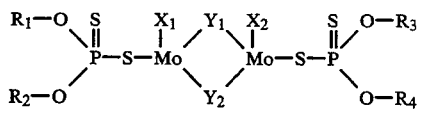

[II]

where $R_1$ to $R_4$ may be the same or different and each is independently a hydrogen atom; an alkyl group having 1 to 20 carbon atoms; a cycloalkyl group having 6 to 26 carbon atoms; an aryl, alkylaryl or arylalkyl group having 6 to 26 carbon atoms; or a hydrocarbon group having 3 to 20 carbon atoms and containing an ester bond, an ether bond, an alcohol group or a carboxyl group, $X_1$ and $X_2$ may be the same or different and each is independently an oxygen atom or a sulfur atom, $Y_1$ and $Y_2$ may be the same or different and each is independently an oxygen atom or a sulfur atom.

3. The oil composition of claim 1 wherein the zinc dithiophosphate and the zinc dithiocarbamate have the respective formulae

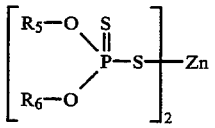

[III]

-continued

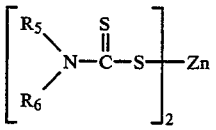

[IV]

wherein $R_5$ and $R_6$ may be the same or different and each is independently a hydrogen atom; an alkyl group having 1 to 20 carbon atoms; a cycloalkyl group having 6 to 26 carbon atoms; an aryl, alkylaryl or arylalkyl group having 6 to 26 carbon atoms; or a hydrocarbon group having from 3 to 20 carbon atoms and containing an ester bond, an ether bond, an alcohol group or a carboxyl group.

4. The oil composition of claim 1 wherein the organic acid amide has the formula

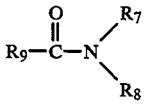

wherein $R_7$ and $R_8$ may be the same or different stand and each is independently a hydrogen atom; an alkyl group having 1 to 20 carbon atoms; a cycloalkyl group having 6 to 26 carbon atoms; an aryl, alkylaryl or arylalkyl group having 6 to 26 carbon atoms; or an alkylene oxide group having 2 to 30 carbon atoms, and $R_9$ is a hydrogen atom; an alkyl group having 1 to 20 carbon atoms; a cycloalkyl group having 6 to 26 carbon atoms; an aryl, alkylaryl or arylalkyl group having 6 to 26 carbon atoms; or a hydrocarbon group having from 3 to 20 carbon atoms and containing an ester bond, an ether bond, an alcohol group or a carboxyl group.

5. A method for reducing friction and copper corrosion in an internal combustion engine which comprises operating the engine with the lubricating oil composition of claim 1.

* * * * *